US006536387B1

(12) United States Patent
Youqing

(10) Patent No.: US 6,536,387 B1
(45) **Date of Patent: *Mar. 25, 2003**

(54) ELECTROMECHANICAL ENGINE VALVE ACTUATOR SYSTEM WITH LOSS COMPENSATION CONTROLLER

(75) Inventor: Xiang Youqing, Canton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/965,228

(22) Filed: Sep. 27, 2001

(51) Int. Cl.[7] ..... F01L 9/04

(52) U.S. Cl. ..... 123/90.11; 251/129.01; 251/129.02; 251/129.16

(58) Field of Search ..... 123/90.11; 251/129.01, 251/129.02, 129.16

(56) References Cited

U.S. PATENT DOCUMENTS 5,884,591 A * 3/1999 Giese ..... 123/90.11
6,044,814 A * 4/2000 Fuwa ..... 123/90.11
6,141,201 A * 10/2000 Schmitz ..... 361/154
6,152,094 A * 11/2000 Kirschbaum ..... 123/90.11
6,340,008 B1 * 1/2002 Boie et al. ..... 123/90.11
6,378,473 B2 * 4/2002 Yamaki et al. ..... 123/90.11
6,390,036 B1 * 5/2002 Yuuki ..... 123/90.11
2002/0011224 A1 * 1/2002 Kumaki et al.

OTHER PUBLICATIONS

Camless engine, Automotive Engineering International, Dec. 2002, pp. 86.*

* cited by examiner

*Primary Examiner*—Thomas Denion
(74) *Attorney, Agent, or Firm*—John E. Kajander

(57) ABSTRACT

An electromechanical engine valve actuation system 10 is provided including a loss compensation controller 16, a first actuator 18, a second actuator 20, an armature element 26 and a motion detector 32. The loss compensation controller 16 calculates the mechanical losses of the armature element and controls the first actuator 18 and the second actuator 20 in response to the mechanical losses in order to reduce the impact of the armature element 26.

20 Claims, 4 Drawing Sheets

ELECTROMECHANICAL ENGINE VALVE ACTUATOR SYSTEM WITH LOSS COMPENSATION CONTROLLER

TECHNICAL FIELD

The present invention relates generally to an electromechanical engine valve actuator system and more particularly to an electromechanical engine valve actuator system with a loss compensation controller for reduced armature impact.

BACKGROUND OF THE INVENTION

Electromechanical engine valve actuation systems utilize electromagnetic actuators to control the movement of an armature and thereby the engine valve. Typically, the armature is moved back and forth between two electromagnets and is held against the face of these magnets depending on which one is actuated. Commonly, one electromagnet represents a closing magnet while the other one represents an opening magnet. To move the cylinder valve from an open position to a closed position, the power is shut off at the open magnet. A restoring spring begins to move the armature away from the open magnet. As the armature passed its resting position, a second restoring spring slows the armature's movement as it approaches the closing magnet. The closing magnet is then charged with a current to capture and hold the armature into the closing position. Often, during this procedure, however, the armature may impact the face of the activated electromagnet with undesirable force. This impact can result in undesirable acoustics as well as undesirable wear on the actuator. The undesirable wear may result in low reliability and durability.

A variety of methods have been developed in an effort to reduce the impact of the actuator on the face of the actuator element. One directional approach to reducing such impact has taken the route of modifying the actuator shape in an attempt to reduce seating impact. These approaches can have negative impacts on design and production costs and leave significant room for improvement in the reduction of seating impact. Other soft seating approaches have contemplated limiting the voltage applied to the coil to a maximum valve when the armature approaches the pole face. Although this method may limit seating impact, it too leaves room for improvement. Present systems often fail to allow for adaptability once integrated into an engine system. A more adaptive system that allowed for and accommodated changes in the engine valve actuation system would be highly desirable.

In an ideal valve actuation system the valve would experience no losses during movement. In such a perfect scenario, the armature would automatically and naturally oscillate between open and closed positions and the armature velocity when it touched the opposite surface would be exactly zero. In reality, losses occur from many effects, such as friction, eddy current losses and aerodynamic forces for example. These forces prevent the armature from reaching the opposing surface without outside excitation. It is implementation that often results in negative armature impact.

It would, therefore, be highly desirable to have an electromechanical engine valve actuation system that provided reduced actuator impact based on compensating for the armature losses such that the electromechanical engine valve actuation system has improved performance and is more adaptive and reliable than present systems.

SUMMARY OF THE INVENTION

It is therefore one object of the present invention to provide an electromechanical engine valve actuation system with a loss compensation controller for reduced armature impact. It is further an object of the present invention to provide such an electromechanical engine valve actuation system with improved flexibility and reliability in reducing actuator impact.

In accordance with the objects of the present invention, an electromechanical engine valve actuator system is provided. The electromechanical engine valve actuation system includes an armature, a first actuator, and a second actuator. A motion detector generates a signal in relation to the armature element's position. The signal is sent to a loss compensation controller that predicts mechanical loses based on the signal. The loss compensation controller controls the first actuator and the second actuator in response to the predicted mechanical losses.

Other objects and features of the present invention will become apparent when viewed in light of the detailed description of the preferred embodiment when taken in conjunction with the attached drawings and appended claims.

DETAILED DESCRIPTION OF THE PREFERRED EMBODIMENT

Figure 1:
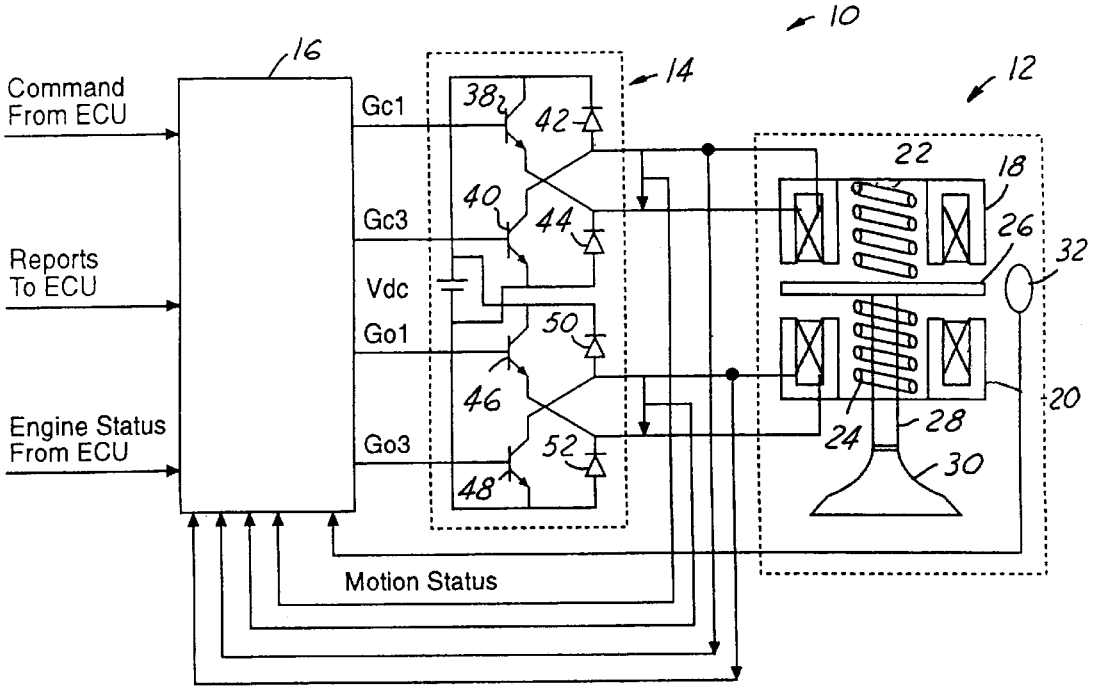
FIG. 1 is an illustration of an embodiment of an electromechanical engine valve actuation system in accordance with the present invention.

Referring now to FIG. 1, which is an illustration of an embodiment of an electromechanical engine valve actuation 10 in accordance with the present invention. The electromechanical engine valve actuation system 10 includes a valve actuator 12, a switching element 14 and a loss compensation controller 16. The valve actuator 12 includes a closing actuator 18, an opening actuator 20, a first restoring spring 22, a second restoring spring 24, and an armature element 26 attached to a stem 28 of a cylinder valve 30.

The present invention further includes a motion detector 32 positioned between the closing actuator 18 and the opening actuator 20. The use of a motion detector 32 allows loss compensation controller 16 to monitor the position and velocity of the armature element 26. By monitoring the position and velocity of the armature element 26, the loss compensation controller 16 can predict the mechanical losses of the armature element 26 using standard and well known engineering techniques. Although a variety of calculation methods are well known in the art, one process utilizes look-up-tables to calculate aerodynamic losses and coulomb and viscous friction calculations to predict frictional losses. Two methods for developing look-up-tables to determine aerodynamic losses are methods well known to engineers. The first method for developing such tables would be through experimental measurements of aerodynamic loss for a specific design of engine valve system 10 throughout a variety of conditions. A second known method for determination of aerodynamic losses would be through the use of fluid-dynamics modeling calculations. As it is logical that aerodynamic losses due to movement of the armature element 26 will be related to the speed of the armature element 26 (and henceforth engine speed), the engine speed may be utilized as additional input data to find appropriate aerodynamic loss values in the look-up-tables. It should be understood that although the aerodynamic losses may not represent a large portion of the losses experienced by the armature element 26, they nonetheless can be utilized to fine tune the loss compensation controller 16. Similarly the calculation of coulomb and viscous friction can further be utilized to fine tune the compensation controller 16 The loss compensation controller 16 can utilize such mechanical losses to adjust the power to the closing actuator 18 or the opening actuator 20 to reduce the impact of the armature element 26 when it comes in contact with either the closing actuator 18 or the opening actuator 20. The use of the motion detector 32 in combination with the loss compensation controller 16 allows for a real time (i.e. during operation) prediction of the armature element 26 losses and thereby allows for such losses to be compensated for allowing for greater control and adjustment of the armature element's 26 movement.

Figure 3A:
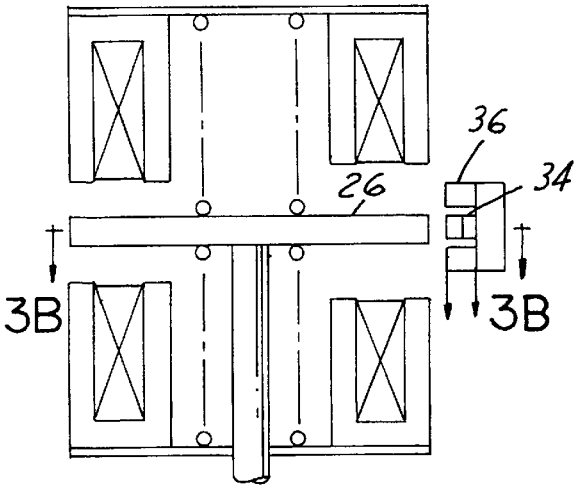
FIG. 3A is a cross-sectional illustration of a valve actuator in accordance with the present invention.
Figure 4A:
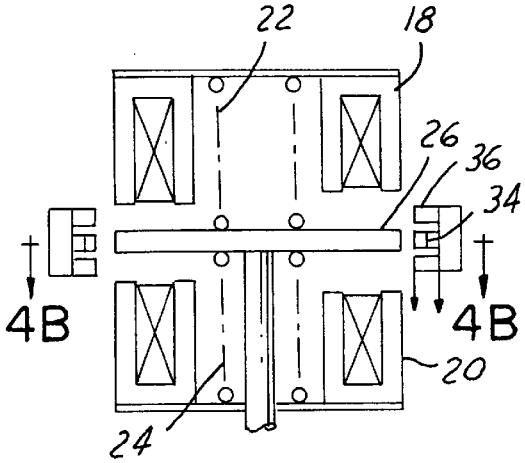
FIG. 4A is a cross-sectional illustration of a valve actuator in accordance with the present invention.
Figure 3B:
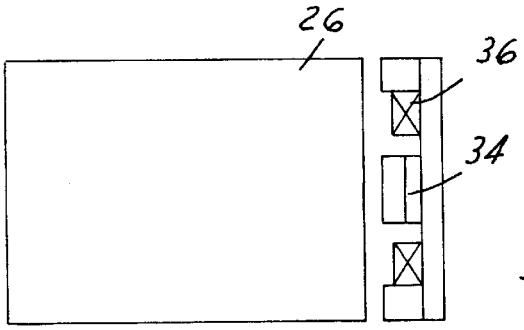
FIG. 3B is a top view detail of a motion detector as illustrated in FIG. 3A in accordance with the present invention.
Figure 4B:
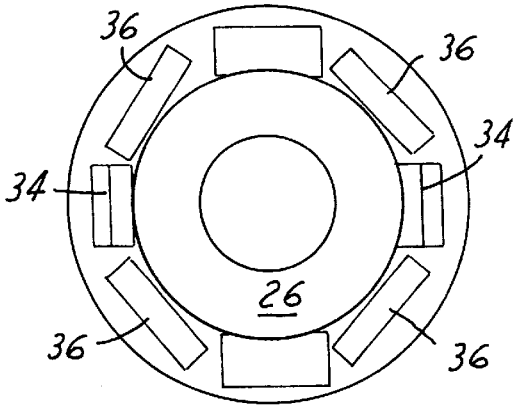
FIG. 4B is a top view detail of a motion detector as illustrated in FIG. 4A in accordance with the present invention.

Although a wide variety of motion detectors 32 are contemplated for use with the present invention, one embodiment, illustrated in FIG. 3, utilizes a permanent magnet 34 positioned between a motion detector coil 36 to create a discrete motion detector 32. In this embodiment, the armature element 26 closes the flux path created by the permanent magnet 34 allowing the controller element 16 which is in communication with the detector coil 36 to determine the position and velocity of the armature element 26 as it passes the motion detector 32. Although one form of discrete motion detector 32 has been described, it should be understood that a wide variety of discrete motion detectors are contemplated by the present invention. The discrete motion detector 32 may also be formed in a variety of configurations, including a square configuration (see FIGS. 3A and 3B) or a circular configuration (see FIGS. 4A and 4B). It should be understood, however, that these configurations are primarily for design and packaging purposes and are not intended as a limitation on the design of the discrete motion detector 32.

The loss compensation controller 16 powers and depowers the closing actuator 18 and the opening actuator 20 through the use of a switching element 14. The use of switching elements 14 to route power to valve actuators 12 is well known in the prior art. The present invention, however, in one embodiment, contemplates the novel use of a regenerative switching power converter as a switching element 14. The regenerative switching power converter 14 includes a first closing gate 38, a second closing gate 40, a first closing diode 42 and a second closing diode 44. The use of such a dual gate/dual diode configuration allows a switch 14 to allow magnetic field energy stored in the closing actuator 18 to be dumped back into a battery (not shown) and thereby increase the efficiency of the electromechanical engine valve actuation system 10. In a similar fashion, the switching element 14 also includes a first opening gate 46, a second opening gate 48, a first opening diode 50, and a second opening diode 52. This portion of the switching element 14 allows the magnetic field energy stored in the opening actuator 20 to be dumped back into a battery (not shown) when the opening actuator 20 is deactivated. The use of such regenerative switching power converters is known in the electronic industry, however, its unique use in combination with the valve actuator 12 as described by the present invention creates a novel electromechanical engine valve actuation system 10 with both improved performance and efficiency.

Figure 2:
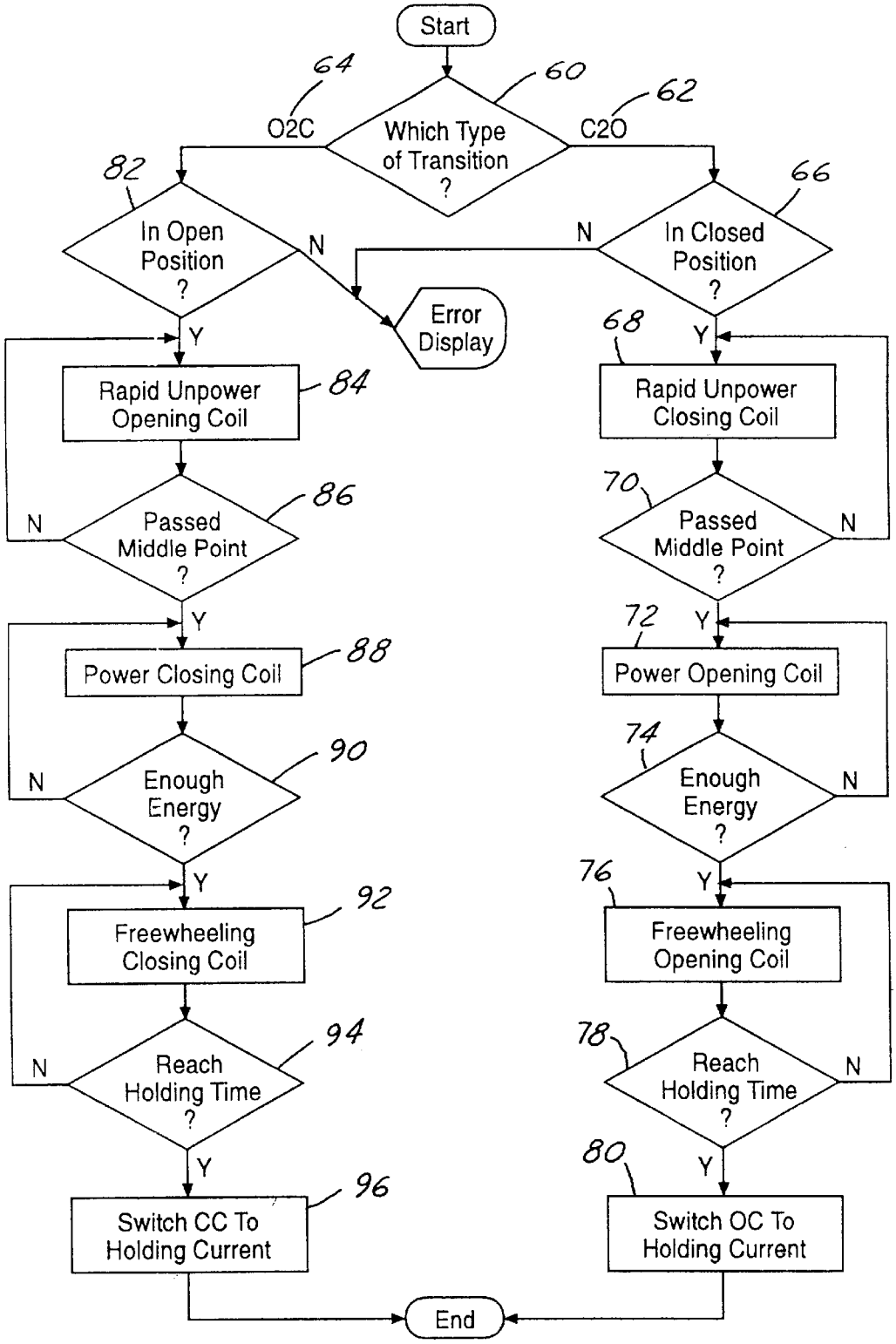
FIG. 2 is a flow chart of the electromechanical engine valve actuation system in accordance with the present invention.

Referring now to FIG. 2, which is a flow chart of the operation of the electromechanical engine valve actuation system 10 as contemplated by the present invention. A method of controlling the valve actuator 12 to reduce armature element 26 impact is illustrated. The method includes determining transition type 60. Determining transition type 60 simply is determining if the armature element 26 is to be moved from a closed position into an open position 62 or from an open position into a closed position 64. If the actuator element 26 is to be moved from a closed position to an open position 62, an initial step of verifying the actuator element 26 is in the closed position 66 may be performed. If it is, the step of rapidly unpowering the closing actuator 68 is performed. Once the closing actuator 18 is unpowered, the first restoring spring 22 will move the armature element 26 away from the closing actuator 18 and towards the opening actuator 20. The motion detector 32 is used to determine when the armature element 26 passes the midpoint between the closing actuator 18 and the opening actuator 20. Once the step of determining is the actuator element has passed the midpoint 70 has been determined, the step of powering the opening coil 72 is performed. The controller element 16 uses the information provided by the motion detector 32 to determine the position and velocity of the armature element 26. With this information, the loss compensation controller 16 can calculate the mechanical losses of the armature element 26 and can power the opening actuator 20 with just enough energy to allow the armature element 26 to overcome such mechanical losses and reach the opening actuator 20. A step of verifying the energy sent to the opening actuator 74 is then performed. Once the correct amount of energy has been sent to the opening actuator 20, the power to the opening actuator 20 is switched off and the armature element 26 moves using momentum towards the opening actuator 20. This step is known as freewheeling the opening coil 76. While the armature element 26 moves toward the opening actuator 20 under its own momentum, the loss compensation controller 16 calculates the time required for the armature element 26 to reach the opening actuator 20. Once the step known as reaching holding time 78 has expired, the step of switching the opening actuator to a holding current 80 is performed. At this step, the opening actuator 20 is powered with a minimum current necessary to hold the armature element 26 against the opening actuator 20. Using this method, including monitoring when the armature element 26 passes the midpoint 70, the power to the opening actuator 20 can be controlled by the loss compensation controller 16 such that the attractive force exerted on the armature element 26 is just enough to compensate for mechanical losses and the armature element 26 will therefore come softly into contact with opening actuator 20. This, in turn, reduces the impact force of the armature element 26 against the opening actuator 20 and thereby increase the performance and reliability of the electromechanical engine valve actuation system 10.

If, on the other hand, the armature element 26 is moving from an open position to a closing position 64, a set of similar steps are performed. In this scenario, the steps consist primarily of determining if the actuator element is in an opened position 82, rapidly unpowering the opened actuator 84, monitoring when the actuator element passes the midpoint between the open actuator and the closed actuator 86, powering closing actuator 88, verifying the energy powered to the closing coil 90, allowing the actuator element to freewheel towards the closing coil 92, calculating the time required for the actuator element to come into contact with the closing actuator 94 and switching the closing coil to a holding current 96. It should be understood that although the present invention has been described in terns of an opened position and a closed position, that these terms are strictly for the purposes of description and not intended as limitations on the present invention. A first position and a second position may be used interchangeably for the terms opened and closed.

Figure 5:
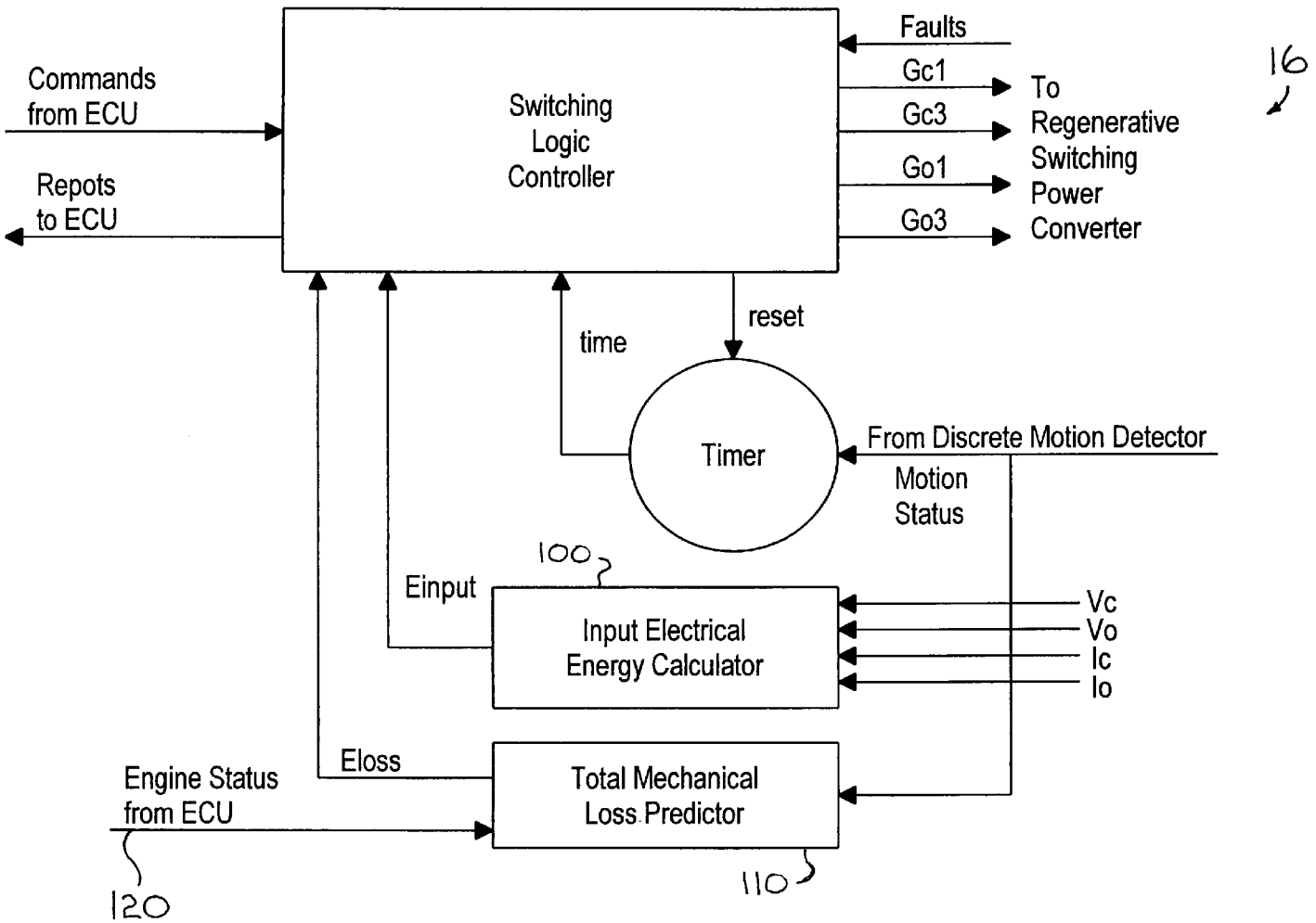
FIG. 5 is a block diagram of loss compensation controllers of the electrical engine valve actuation system in accordance with the present invention.

In another embodiment illustrated in FIG. 5, it is contemplated that the loss compensation controller 16 may include an input energy calculator 100 as well as the mechanical loss calculator 110. In addition, the loss compensation controller 16 may use a variety of additional input data to predict the total mechanical losses of the armature element 26. One such additional input is contemplated to be engine status, such as engine speed and engine load for example, from the engine control unit 120. This information is particularly useful in calculating aerodynamic losses based on look-up tables. Although the calculation of frictional and aerodynamic losses have been discussed, it should be understood that both of these losses need not be calculated to practice the present invention. It should also be understood that a wide variety of methods of calculating these losses are known in the prior art and are contemplated by the present invention.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. An electromechanical engine valve actuation system comprising:

a loss compensation controller;

a first actuator;

a second actuator, an armature element positioned between said first actuator and said second actuator; and a motion detector generating a signal in relation to said armature element's position, said motion detector element sending said signal to said loss compensation controller when said armature element reaches a midpoint between said first actuator and said second actuator, wherein said loss compensation controller calculates mechanical losses of said armature element and controls said first actuator and said second actuator in response to said mechanical losses to reduce the impact of said armature element by rapidly unpowering said first actuator, followed by rapidly first powering said second actuator when said armature element reaches said midpoint, rapidly unpowering said second actuator immediately after said first powering to allow said armature element to free wheel towards said second actuator, and second powering said second actuator with a holding current once said armature element reaches said second actuator.

2. An electromechanical engine valve actuation system as described in claim 1 wherein said motion detector comprises:

a permanent magnet; and a motion detector coil.

3. An electromechanical engine valve actuation system as described in claim 1 further comprising:

a first restoring spring; and a second restoring spring.

4. An electromechanical engine valve actuation system A method as recited in claim 1 further comprising:

a switching element.

5. An electromechanical engine valve actuation system as described in claim 4 wherein said switching element comprising a regenerative switching power converter.

6. An electromechanical engine valve actuation system as described in claim 4 wherein said switching element comprises:

at least two closing gates and at least two diodes forming a regenerative switching power converter.

7. An electromechanical engine valve actuation system as described in claim 1 wherein said first actuator is a closing actuator for closing an engine valve; and said second actuator is an opening actuator to open said engine valve.

8. An electromechanical engine valve actuation system as described in claim 1 wherein said mechanical losses include frictional losses.

9. An electromechanical engine valve actuation system as described in claim 1 wherein said mechanical losses include aerodynamic losses determined using an engine status input.

10. An electromechanical engine valve actuation system comprising:

a loss compensation controller;

a switching element;

a first actuator;

an second actuator, an armature element positioned between said first actuator and said second actuator;

a first restoring spring biasing said armature element away from said first actuator;

a second restoring spring biasing said armature element away from said second actuator; and a motion detector generating a signal in relation to said armature element's position, said motion detector element sending said signal to said loss compensation controller, wherein said loss compensation controller calculates the mechanical losses of said armature element as said armature element is moving from said first actuator to said second actuator, said loss compensation controller controlling said first actuator and said second actuator in response to said mechanical losses to reduce the impact of said armature element by rapidly unpowering said first actuator, followed by rapidly first powering said second actuator when said armature element reaches a midpoint, rapidly unpowering said second actuator immediately after said first powering to allow said armature element to free wheel towards said second actuator, and second powering said second actuator with a holding current once said armature element reaches said second actuator.

11. An electromechanical engine valve actuation system as described in claim 10 wherein said motion detector comprises:

a permanent magnet; and a motion detector coil.

12. An electromechanical engine valve actuation system as described in claim 10 wherein said switching element comprising a regenerative switching power converter.

13. An electromechanical engine valve actuation system as described in claim 10 wherein said switching element comprises:

at least two closing gates and at least two diodes forming a regenerative switching power converter.

14. An electromechanical engine valve actuation system as described in claim 10 wherein said first actuator is a closing actuator for closing an engine valve; and said second actuator is an opening actuator to open said engine valve.

15. An electromechanical engine valve actuation system as described in claim 10 wherein said mechanical losses include aerodynamic losses determined using an engine status input.

16. A method of moving an armature element from a first position in contact with a first actuator to a second position in contact with a second actuator comprising:

rapidly unpowering the first actuator;

monitoring, after said rapidly unpowering of the first actuator, when the armature element reaches a midpoint between the first actuator and the second actuator using a motion detector;

calculating the mechanical losses of said armature element as said armature element is moving from said first actuator to said second actuator;

rapidly first powering the second actuator to compensate for said mechanical losses when the actuator element reaches said midpoint;

rapidly unpowering the second actuator immediately after said first powering and allowing the armature element to freewheel towards the second actuator; and powering the second actuator with a holding current when the armature element reaches the second actuator.

17. A method as described in claim 16, further comprising:

moving the armature element away from the first actuator using a first restoring spring.

18. A method as described in claim 16, further comprising:

capturing at least a portion of the magnetic energy stored in the first actuator.

19. A method as described in claim 16, wherein said motion detector comprises:

a permanent magnet; and a motion detector coil.

20. A method as described in claim 16 further comprising:

monitoring the armature elements position and velocity using said motion detector.

* * * * *